235-379 SR
12/2/85 XR 4,625,870

United States Patent [19]

Nao et al.

[11] Patent Number: 4,625,870

[45] Date of Patent: Dec. 2, 1986

[54] BILL HANDLING APPARATUS

[75] Inventors: Manabu Nao, Ebina; Hisao Hirota, Kodaira, both of Japan

[73] Assignee: Fujitsu Limited, Kawasaki, Japan

[21] Appl. No.: 537,010

[22] Filed: Sep. 29, 1983

[30] Foreign Application Priority Data

Sep. 29, 1982 [JP] Japan ..... 57-170563

[51] Int. Cl.[4] ..... B07C 5/38; G07D 7/00

[52] U.S. Cl. ..... 209/534; 235/379; 271/3.1; 271/9; 271/65; 271/163; 271/178; 271/186; 271/192

[58] Field of Search ..... 209/534, 540, 545; 235/379, 475–477; 271/3.1, 9, 65, 163, 177, 178, 186, 189, 192, 218

[56] References Cited

U.S. PATENT DOCUMENTS

| | | | |
|---|---|---|---|
| 3,930,581 | 1/1976 | Gray | 209/534 |
| 4,465,192 | 8/1984 | Ohba et al. | 271/3.1 X |
| 4,465,193 | 8/1984 | Kokubo et al. | 209/534 |
| 4,465,925 | 8/1984 | Goi | 209/534 X |
| 4,510,380 | 4/1985 | Uchida et al. | 235/379 |

FOREIGN PATENT DOCUMENTS

| | | | |
|---|---|---|---|
| 54-33795 | 3/1979 | Japan | 209/534 |
| 54-47904 | 4/1979 | Japan | 209/534 |
| 56-63664 | 5/1981 | Japan | 235/379 |

*Primary Examiner*—Robert B. Reeves
*Assistant Examiner*—Edward M. Wacyra
*Attorney, Agent, or Firm*—Staas & Halsey

[57] ABSTRACT

A bill handling apparatus of the recycle type having a bill receiving system and a bill disbursing system. The bill receiving system includes a bill insertion opening, a bill discriminating unit, a unit for arranging bills so that the front and back sides of the bills face in the same direction and for accumulating the bills, and bill-receiving boxes for receiving bills according to denomination. The bills to be deposited are fed from the bill insertion opening, via the discriminating unit, to the bill arranging and pooling unit and, thereafter, via the discriminating unit, to the bill receiving boxes. The bill disbursing system is constructed so that the bills received in the bill receiving boxes are fed, via the discriminating unit, to a bill disbursing opening.

15 Claims, 15 Drawing Figures

18
KEYBOARD
4
DISPLAY
5
CONTROL UNIT
DISCRIMINATION CONTROL
181
SENSOR AMPLIFIER
182
186
187
S1
S2
S3
S4
S5
S6
S7
S8
S9
S10
S11
S12
S13
S14
S15
S16
S17
S18
S19
S20
S21
S22
S23
S24
MAGNET DRIVE
183
GM
G1
G2
G3
G4
G5
G6
G7
G8
G9
MOTOR DRIVE
184
M1
M2
M3
M4
M5
CLUTCH MAGNET DRIVE
185
C1
C2
C3
C4
C5

BILL HANDLING APPARATUS

BACKGROUND OF THE INVENTION

1. Field of the Invention

The present invention relates to a bill handling apparatus, such as an automated teller machine (ATM), operated by a user to complete transactions. More particularly, the present invention relates to a bill handling apparatus of the recycle type in which received bills are arranged so that the front and back sides face the same direction and in which the mechanisms are simplified.

2. Description of the Prior Art

Automated teller mechanisms (ATM) are now widely used in banks and the like as a part of computer banking systems. In an ATM, a credit card ("card") or a bank book are ordinarily used to effect disbursement of cash and acceptance of deposits. The convenience of ATM's has led to their increasing use. Conventional ATM's, however, have the disadvantage that when a bill-receiving box becomes full, it is necessary to take out the bills from the box or replace the box with an empty one. For this purpose, the ATM must temporarily be stopped. On the other hand, in the case of disbursement, when bills set in the cash dispenser have been exhausted, a new supply of bills must be provided. The ATM must also be stopped for this purpose. Temporary storage is not preferred for an ATM as it detracts from customer service. Accordingly, temporary stoppage should be avoided. Furthermore, the receiving box sometimes becomes full with bills, while the cash dispenser becomes empty, resulting in ineffective utilization of bills.

Recently, a recycle type ATM has been developed to eliminate the above-mentioned disadvantages. This ATM arranges and stores accepted bills according to denomination and uses them for disbursement. This increases the utilization efficiency of bills, minimizes stoppage of the ATM, and facilitates control of the apparatus. In the conventional ATM of this type, however, bills are received in the upper portion of the receiving box and delivered from the lower portion of the receiving box. Since the receiving box has openings in both the upper and lower portions thereof, the receiving box is not suitable as a safe. Also, since the compressing force on bills in the delivery mechanism is uneven, the delivery becomes uncertain. A complicated mechanism is thus necessary for standardizing this compressing force.

Moreover, in order to improve customer service, it is desired that the bills to be disbursed be arranged with the front and back sides facing the same directions. The conventional apparatus of the recycle type does not function to arrange deposited bills so that the front and back sides face the same direction.

SUMMARY OF THE INVENTION

It is a primary object of the present invention to provide a new and improved bill handling apparatus of the recycle type which eliminates the disadvantages of the prior art.

A further specific object of the present invention is to provide a recycle type of bill handling apparatus which functions to arrange bills deposited so that the front and back sides face the same direction.

Another object of the present invention is to provide such an apparatus which uses a single unit for the discrimination of both deposited bills and bills to be disbursed.

According to the present invention, there is provided a bill handling apparatus which comprises: a bill receiving means including a bill insertion opening in which bills are inserted by users; a means for discriminating bills; a means for arranging and accumulating bills so that the front and back sides thereof face the same directions and pooling or accumulating the arranged bills; bill-receiving boxes for receiving bills according to denominations; a first means for feeding the bills inserted in the insertion opening, via the discriminating means, to the bill arranging and pooling means; and a second means for feeding the bills pooled in the bill arranging and pooling means, via the discriminating means, to the bill-receiving boxes; a bill disbursing means including an opening from which bills are disbursed to users and a means for feeding the bills received in the bill-receiving boxes, via the discriminating means, to the disbursing opening; and a reject box for recovering bills which are not discriminated in said discriminating means, other bills which are unsuited for disbursement, and the like.

BRIEF DESCRIPTION OF THE DRAWINGS

The present invention will now be described in detail based on preferred embodiments with reference to the accompanying drawings, wherein.

DESCRIPTION OF THE PREFERRED EMBODIMENTS

Figure 1:
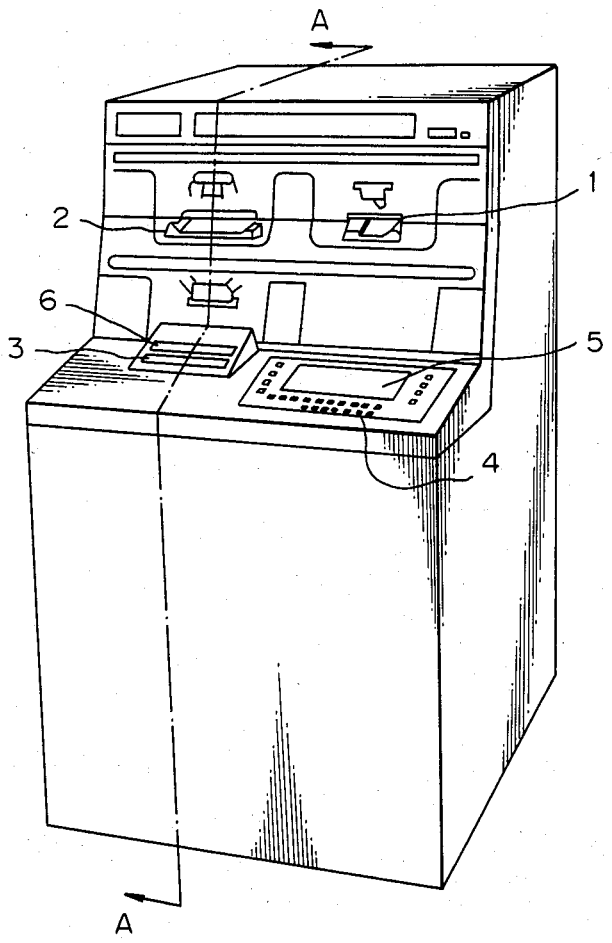
FIG. 1 is a perspective external view of a bill handling apparatus of the recycle type according to the present invention.

In FIG. 1, on the right side of the upper portion of the front face of the apparatus, there is formed a card insertion opening 1, and on the left side, a bankbook insertion opening 2. In a panel, located below these openings 1 and 2, a display 5 and a keyboard 4 are arranged on the right side and a bill insertion opening 6 and a bill disbursing opening 3 are arranged on the left side.

Figure 2:
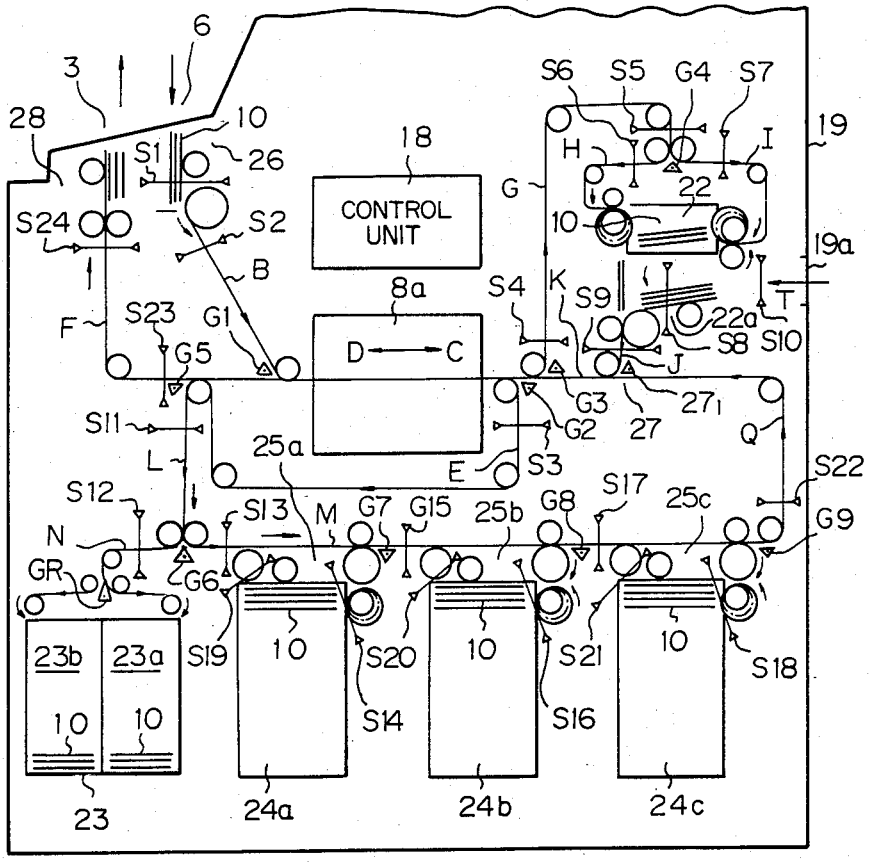
FIG. 2 is a partial schematic sectional view taken along line A—A in FIG. 1, illustrating the structure of the bill handling apparatus.

In accordance with the invention, the bill handling apparatus comprises a bill-receiving means. Referring to FIG. 2, the bill-receiving means includes a bill feeding unit 26 functions to feed or deliver bills 10 inserted in the bill insertion opening 6 one by one. A shutter (not shown) is arranged in the bill insertion opening 6 so that the shutter is opened when bills 10 are inserted in the opening 6. A discriminating means or unit 8*a* discriminates genuineness, denomination, side, and condition of the bills 10. A bill-arranging and accumulating pooling unit 22 arranges the discriminated bills 10 so that the front and back sides of the bill face the same direction and pools them. A first means, for feeding the bills inserted in the insertion opening, via said discriminating means, to said bill arranging and accumulating means, includes the insertion opening, the feeding unit 26, and paths B, G, H, F, and K, as shown in FIG. 2.

The arranging and accumulating unit 22 comprises a delivery unit 22*a* for delivering the bills 10 one by one. Bill-receiving boxes 24*a* through 24*c* are adapted for receiving and storing the bills 10 according to denomination. Above these boxes, receiving and delivery mechanisms 25*a* through 25*c* are disposed, respectively. A reject box 23 is adapted for recovering bills 10 when judged to be damaged or not of the desired denomination by the discriminating unit 8*a*, when erroneous double-feeding of bills from, for example, the delivery unit 22*a* takes place, when an erroneous number of bills are fed by the receiving and delivery units 25*a*, 25*b*, or 25*c*, or when the bills disbursed through the disbursing opening 3 are left behind by mistake. A third means, for feeding bills accumulated in the bill arranging and accumulating means, via the discriminating means, to the bill-receiving boxes, includes delivery unit 22*a*, the receiving and delivery mechanisms 25*a* through 25*c*, and paths J, K, L, and M as shown in FIG. 2.

Feed rollers for moving bills 10, sensors S1 through S24 for sensing the presence and passage of bills 10, gates G1 through G9, and guide 271 are arranged in the respective passages, branching points, and at joining point 27. A disbursing means or unit 28 is arranged to temporarily hold bills 10 to be disbursed and spurious bills to be returned. When the numbers of bills 10 stored in the receiving boxes 24*a* through 24*c* becomes excessively larger or smaller than a predetermined number, a detecting means (not shown) actuates an alarm. If bills are excessively stored, some of them are recovered in the reject box 23. When the number of stored bills is too small, bills 10 are inserted in the delivery unit 22*a* through an inlet 19*a* arranged on the back side of the apparatus in a direction indicated by arrow T to effect supplementation of bills.

Figure 9:
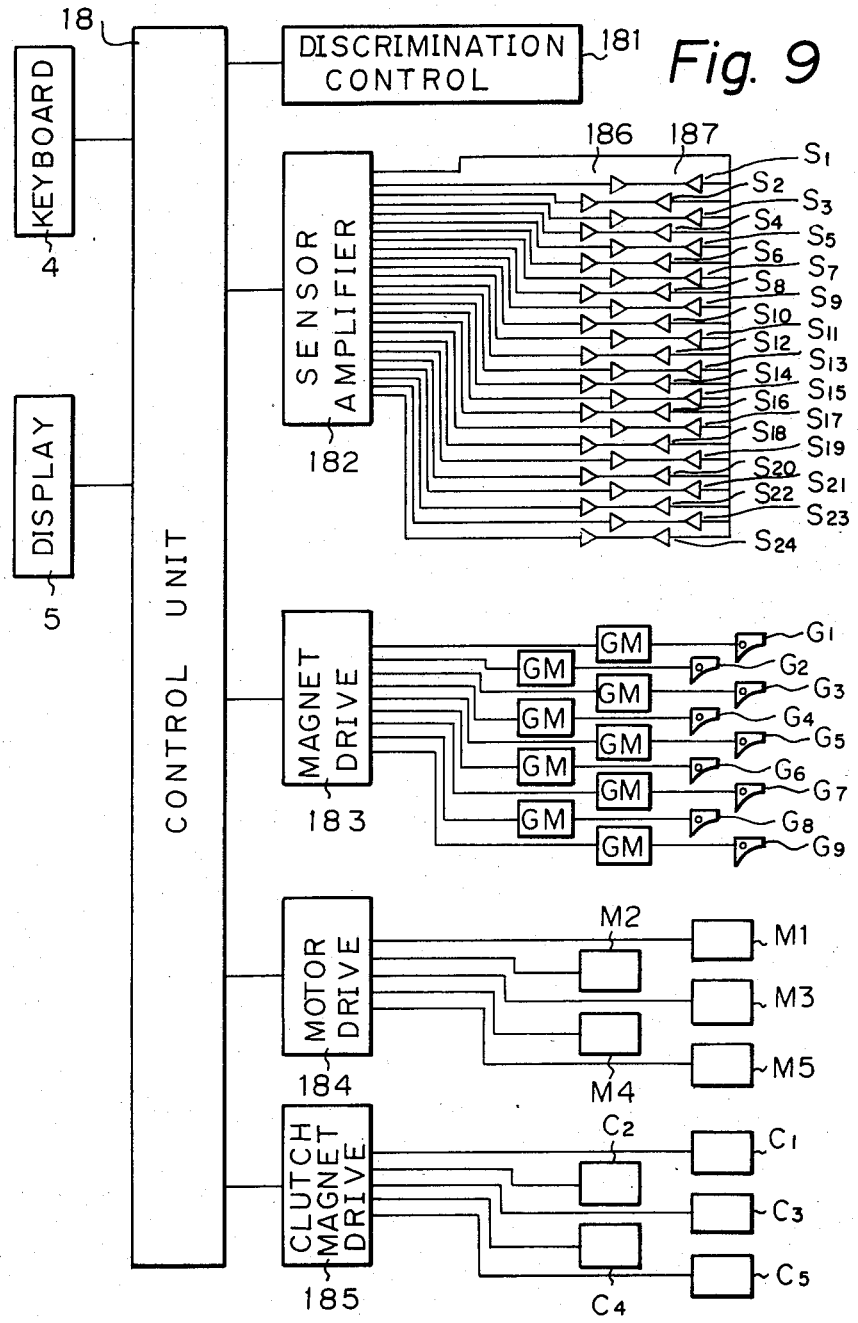
FIG. 9 is a block diagram of a control unit.

FIG. 9 is a block diagram of the control unit 18. A discrimination control 181 controls the discrimination of genuineness, denomination, side, and condition of bills 10 by the discriminating unit 8*a* and supplies results of the discrimination to a control unit 18. A sensor amplifier 182 amplifies detection signals produced by detection of bills 10 by sensors S1 through S24. The sensor amplifier 182 comprising a photodiode 186 and a phototransistor 187 and feeds the amplified signals to the control unit 18. A magnet drive 183 gives a driving signal to a corresponding gate magnet GM according to a selection signal from the control unit 18 to control exchange among gates G1 through G9. A motor M1 is used for delivering out bills 10, a motor M2 is used for driving a one-way rotating roller, a motor M3 is used for driving a roller capable of rotating in the normal and reverse directions, and motors M4 and M5 are used for driving a moving mechanism. Reference numerals 184 represents a motor drive. A clutch magnet drive 185 receives a signal from the control unit 18 and actuates the motor M1 to operate clutches C1 through C5 to intermittently rotate a pick roller, described hereinafter.

Figure 3:
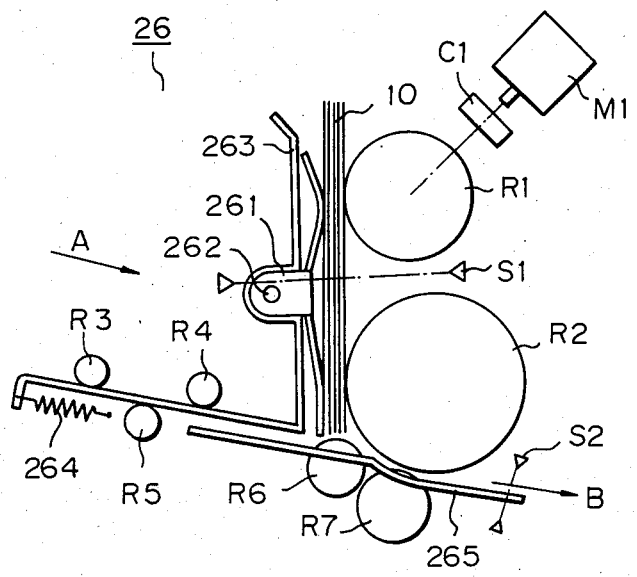
FIG. 3 is a schematic side view of a delivery unit for bills inserted for deposit.

The units and functions in the embodiment shown in FIG. 2 will now be described. As shown in FIG. 3, the feeding unit 26 comprised pick roller R1 and feed roller R2 arranged in the upper and lower portions, respectively. The pick roller R1 is connected to the motor M1 through the clutch C1. A pressing member 261 confronts or faces the pick roller R1 and feed roller R2 at certain distances therefrom and is rotatably supported on a shaft 261. The shaft 262 is attached to an L-shaped guide frame 263. The guide frame 263 is gripped by guide rollers R3 through R5 and urged in a direction of arrow A by springs 264 attached on both the left and right ends, so that the distance of the pick roller R1 and feed roller R2 from the pressing member is broadened or narrowed by the driving or restoration of a retreat mechanism (not shown). A delivery guide plate 265 is arranged below the feed roller R2 and guide frame 263 and a separate roller R6 rotating in the reverse direction is disposed below the delivery guide plate 265 to prevent double-feeding. An accelerating roller R7 is arranged to have a rolling contact with the feed roller R2. A clearance, allowing the passage of a bill 10, is set between the feed roller R2 and the feeding guide plate 265. A sensor S1 is disposed for detecting the insertion of bills 10 in a bill receiving zone defined by the pressing member 261 and the rollers R1 and R2. A sensor S2 is arranged at the outlet of the delivery unit 26 to detect the passage of a bill 10. When the insertion of bills is detected by the sensor S1, a shutter (not shown), in the insertion opening 6, is closed.

When the insertion of bills 10 in the receiving zone defined by the pick roller R1, feed roller R2, and pressing member 261 is detected, the distance between the rollers R1 and R2 and the pressing member 261 is narrowed by restoration of the retreat mechanism. Accordingly, when the bills 10 are gripped by the surfaces of the pick roller R1, feed roller R2, and pressing member 261 by driving of the pick roller R1, feed roller R2, and separate roller R6, the bills 10 are delivered out one by one to a route indicated by arrow B while being guided by the delivery guide plate 265.

Figure 4:
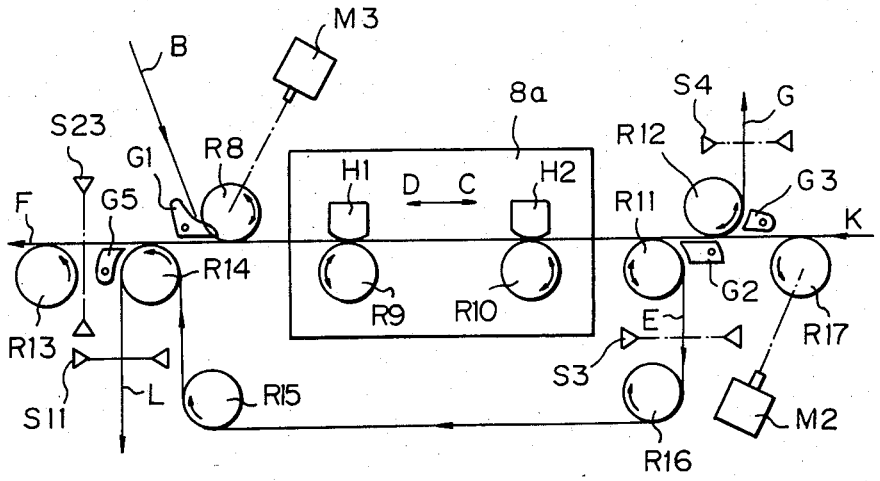
FIG. 4 is a schematic side view of transport passages of bills around a discriminating unit.

FIG. 4 illustrates the discriminating unit 8*a* and neighboring passages for bills 10. The interior of the discriminating unit 8*a*, contains feed rollers 9 and 10 which are capable of rotating in the normal and reverse directions and are arranged to confront magnetic read heads H1 and H2 and deliver bills 10, respectively, while gripping them between the rollers and the magnetic heads. On the left side of the discriminating unit 8*a*, as shown in FIG. 4, a gate G1 and a roller R8, capable of rotating in the normal and reverse directions, are arranged above the crossing point between the transport passage of the route B for inserted bills 10 and the transport passage of the route F for bills 10 transported from the right side of the discriminating unit 8*a*. A gate G5 and feed rollers R13 through R15 are arranged below the passage of route F. On the right side of the discriminating unit 8*a*, a gate G2, a feed roller R11, capable of rotating in the normal and reverse directions, and one-way rotating feed rollers R16 and R17 are arranged below the passage of route K, while a gate G3 and a feed roller R12 capable of rotating in the normal and reverse directions are arranged on the upper side of the passage of route K. The one-way rotating feed roller R17 is connected to the motor M2, and the feed roller R8 capable of rotating in the normal and reverse directions is connected to motor M3. Feed rollers R9 through R12, capable of rotating in the normal and reverse directions, are driven by the feed roller R8, and the one-way rotating feed rollers R13 through R16 are driven by the feed roller R17. The feed rollers R8 and R12 are rotated in a direction reverse to the rotation direction of the rollers R9 through R11. For example, each feed roller may be rotated in the direction for delivery of bills 10.

Sensors S3, S4, S11, and S23, for detecting the passage of bills 10, are arranged between the feed rollers R11 and R16, at the entrance to route G from the feed roller R12, in the branched passage through the feed roller R14 and gate G5 and between the feed rollers R13 and R14, respectively.

The gate G1 is located at the upper position when bills 10 are in the normal state. It is brought down to the lower position while bills 10 are stored. The gate G2 is located at the lower position when bills 10 are in the normal state, but it is raised to the upper position when a bill 10 is returned as the result of discrimination. The gate G3 is located at the upper position in the normal state and brought down to the lower position at the time of disbursement. The gate G5 is located at the lower position in the normal state, but it is raised to the upper position at the time of storing and rejecting.

Accordingly, by reading and detecting signals of the magnetic heads H1 and H2 and sensors S3, S4, S11, and S23, the motors M1 and M2 are driven to actuate the gates G2, G3, and G5 to deliver bills 10 along predetermined delivery passages, as described in detail hereinafter.

Figure 5:
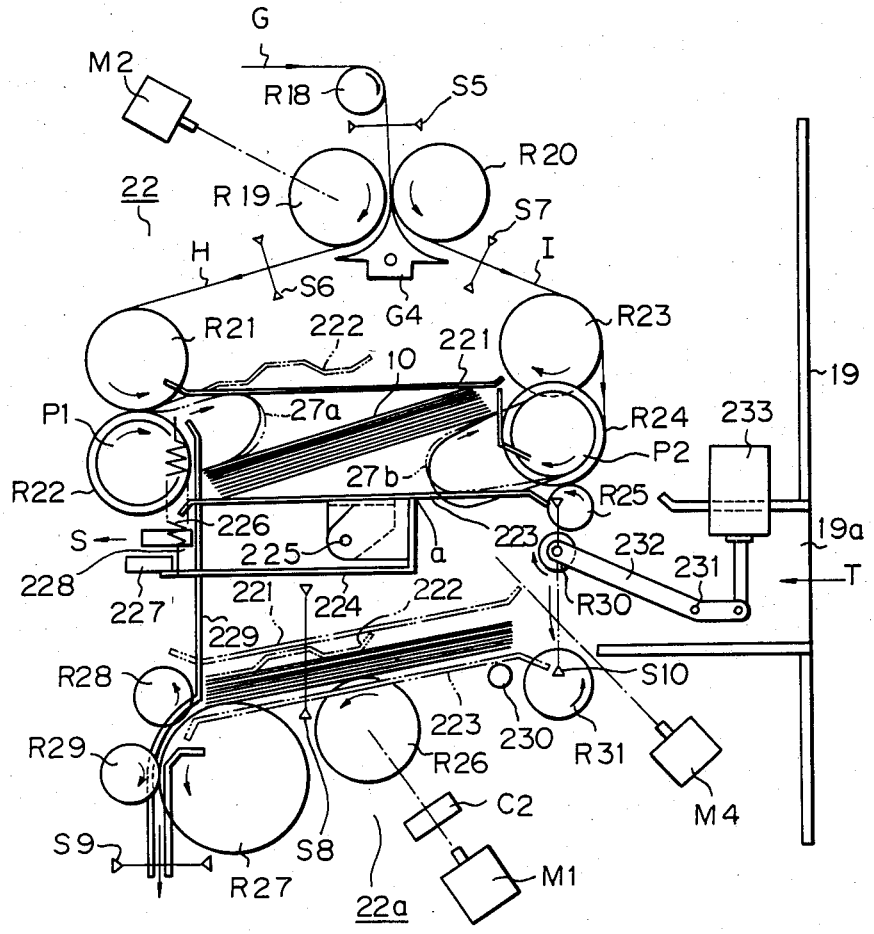
FIG. 5 is a schematic side view of a bill-arranging and pooling unit.

In the bill arranging and pooling unit 22, as shown in FIG. 5, the feed rollers R18, R19, and R20 are arranged in the upper portion. The feed roller R19 has a rolling contact with the feed roller R20. A gate G4 is disposed below the feed rollers R19 and R20 in close proximity thereto. In the normal state, the gate G4 is tilted to the right, as in FIG. 5. When the back side of the bill 10 is detected by the discriminating unit 8*a*, the gate G4 is turned to the left by instructions of the control unit 18.

A top plate 221 is arranged below the gate G4 and an accumulating plate 223 is arranged below the top plate 221. A presser 222 indicated by a two-dot chain line in FIG. 5 is attached to the top plate 221. When the top plate 221 is located at the position shown in FIG. 5, the presser 222 is located above the top plate 221. When the top plate 221 is moved to the lower position, as indicated by a two-dot chain line, the presser 222 is exposed below the top plate 221. The accumulating plate 223 is rotatably supported on a supporting member 224, through a shaft 225, at the point a, so that the accumulating plate 223 can be rotated to the left, but is not allowed to turn to the right.

A spring 226 is arranged on the left end of the supporting member 224 so that the supporting member 224 is hung and pulled from above. The left end of the supporting member 224 is engaged with a stopper 227. The top plate 221 and accumulating plate 223 are independently moved in the vertical direction by a driving mechanism (not shown). This driving mechanism is connected to the motor M4. When the top plate 221 is moved to the lower position the presser 222 presses on the bills 10 which in turn press on the accumulating plate 223 and the accumulating plate 223 is moved to the lower position together with the top plate 221.

A stopper 228 is arranged above the stopper 227 and is moved in a direction of arrow S by a plunger magnet (not shown).

A butting plate 229 is vertically arranged on the left side of the accumulating plate 223.

Feed rollers R21 and R22 and feed rollers R23 through R25 are arranged on the left and right sides of the top plate 221 and accumulating plate 223, respectively. Feed roller R21 is in rolling contact with feed roller R22, and feed roller R24 is in rolling contact with feed roller R25. A pulley P1 is arranged coaxially with the feed roller R22, and a ring belt 27*a* having a diameter larger than that of the pulley P1 is hung on the pulley P1. A pulley P2 is arranged coaxially with the feed roller R24 and a ring belt 27*b* having a diameter larger than that of the pulley P2 is hung on the pulley P2. The feed roller R19 is connected to the motor M2 and feed rollers R20 to R25 are also driven by the feed roller R19.

A delivery or sending unit 22*a* for delivering out bills 10 is arranged below the accumulating plate 223. The delivery unit 22*a* comprises a pick roller R26, a feed roller R27, a separate roller R28 arranged to confront the feed roller R27 at a certain distance therefrom, for preventing double-feeding of bills 10, and an accelerating roller R29, in rolling contact with the feed roller R27. The pick roller R26 is connected through the clutch C2 to the motor M1.

A stopper 230 is arranged below the right end portion of the accumulating plate 223, and an upper roller R30 and a lower roller R31 are arranged separately from each other in the vertical direction. An upper roller R30 is rotatably attached to the top end of a lever 232 moving with a shaft 231 as the fulcrum, and the rear end of the lever 232 is connected to a plunger magnet 233. A lower roller R31 is connected to the motor M2.

A sensor 55 is arranged below feed roller R18, that is, in the end portion of the route G, to detect the passage of bills 10. Furthermore, sensors S6 and S7 are arranged along routes H and I, and sensors S8 and S9 are arranged above the intermediate point between the pick roller R26 and the feed roller R27 in front of the feed roller R27 and the accelerating roller R29 below the rollers R27 and R29, to detect the passage and presence of bills 10. Moreover, a sensor S10 is arranged substantially on the center line between the upper roller R30 and lower roller R31. When the sensor S10 detects the presence of a bill 10, the plunger magnet 231 is actuated to bring down the upper roller R30 and grip the bill 10 between the upper roller R30 and lower roller R31.

On the back face of the apparatus, an inlet 19*a* is formed on a door 19 in the right position shown in FIG. 5, and supplementary bills 10 can be inserted along an arrow T.

Bills 10 which have been judged as being genuine by the discriminating unit 8*a* and have been transported along the route G are fed from the feed roller R18 to the feed rollers R19 and R20. Since the gate G4 is located on the right side, bills 10 judged as being "front" are advanced in the direction of arrow H, introduced into the accumulating part of the bill arranging and pooling unit 22 by the feed rollers R21 and R22, pressed by the rotation of the ring belt 27*a* in the direction indicated by the arrow and accumulated as shown in FIG. 5. When bills 10 are judged as being "back", the gate G4 is shifted to the left, and the bills 10 are advanced in the direction of arrow I and pressed through the feed roller R23. The moving direction is changed by the feed rollers R24 and R25 to turn the bills 10 over, and the bills 10 are introduced into the accumulating part. At this point, the rear ends of the bills 10 are lifted up onto the ring belt 27*b* by the rotation of the ring belt 27*b* in the direction of the arrow, and the bills are placed below the accumulated bills 10 in the tilting posture. The delivered bills 10 are accumulated in the state where the front and back sides of the bills 10 face in the same direction and the bills 10 are brought in contact with the continuously rotating ring belts 27*a* and 27*b*. While accumulation is thus repeated, the accumulating plate 223 is brought down against the elastic force of the spring 226 according to the number of accumulating bills 10. Therefore, the bills 10 can be accumulated in the state where the front and back sides of the bills 10 face the same direction.

When the accumulation of bills 10 for one transaction is completed, the upper plate 221 is brought down and the presser 222 is further brought down while pressing the bills 10 on the accumulating plate 223. At this point, the right end of the accumulating plate 223, as shown in FIG. 5, engages with the stopper 230 and the accumulating plate 223 is tilted to the left, with the shaft 225 acting as a fulcrum and is stopped. Accordingly, it is now possible to deliver out bills 10 with pick roller R26 and feed roller R27, that is, the delivery unit 22*a*.

At the time of supplementation of bills 10 through inlet 19*a*, on receipt of bill-supplying instructions, the upper plate 221 is brought down and stopped by the stopper 288, while the accumulating plate 223 is brought down and stopped at the delivery position.

If a predetermined number of bills 10 to be supplied are inserted through the inlet 19*a*, the sensor S10 detects the insertion and actuates the upper and lower rollers R30 and R31 to grip the bills 10 therebetween, and the bills 10 are fed onto the accumulating plate 223. When the passage of the rear ends of the bills 10 through the position of the sensor S10 is detected, the stopper 228 is retracted in the direction of arrow S. The upper plate 221 is further brought down and the presser 222 presses the bills 10. The pick roller R26 and feed roller R27 are driven to deliver out the bills 10, and the bills 10 are supplementarily stored into the receiving box 24*a*, 24*b*, or 24*c* of the desired denomination.

Figure 6:
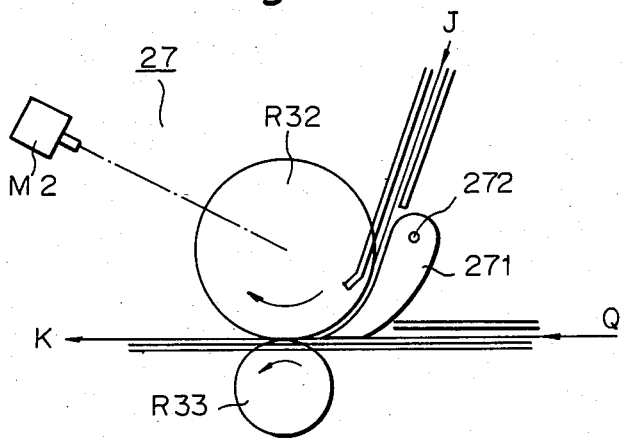
FIG. 6 is a schematic side view of a junction of the bill transporting passages.

The passage for bills 10 delivered out from the delivery unit 22*a* and the passage for bills 10 to be disbursed join at the joint portion 27, as shown in FIG. 6. At the crossing point where the routes J and Q join to form a route K, and guide 271 capable of swinging by gravity is supported on a support 272. In front of the guide 271, that is, in the left portion of FIG. 6, feed rollers R32 and R33 are arranged so that they are in rolling contact with each other and with the transport passage interposed therebetween. Feed roller R32 is connected to the motor M2.

Bills 10 transported along the route J are guided by the guide 271 and fed into the route K by the feed rollers R32 and R33, while the bills 10 transported along the route Q press up the guide 271 and pass underneath guide 271 and are similarly fed into the route K by the feed rollers R32 and R33.

Figure 7:
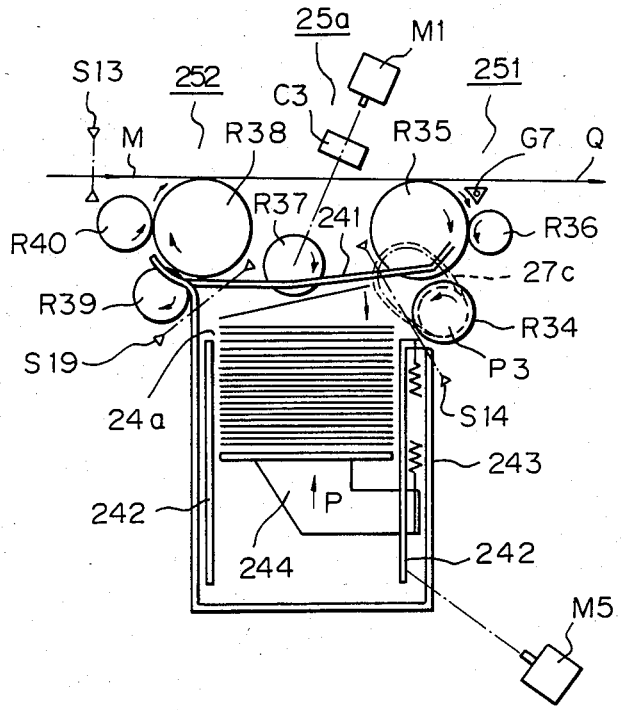
FIG. 7 is a schematic side view of a bill-receiving box with a receiving and delivery unit therefor.

The receiving and delivery mechanisms 25*a* through 25*c* will now be described in detail. One of the receiving boxes 24*a* through 24*c*, 24*a*, for the respective denominations is shown in FIG. 7. The receiving and delivery mechanism 25*a* is formed above the receiving box 24*a*, and a receiving mechanism 251 for feeding bills 10 into the box 24*a* is arranged on the right side. A delivery mechanism 252 for delivering out bills 10 from the box 24*a* is arranged on the left side.

The receiving mechanism 251 comprises feed rollers R34 and R35, a pulley P3 coaxially mounted on the feed roller R34, and a ring belt 27*c*. The ring belt 27*c* has a diameter larger than that of the pulley P3 and is hung on the pulley P3, and the feed rollers 34 and 36 have a rolling contact with the feed roller R35. A changeover gate G7 (gates G8 and G9 for the corresponding boxes 24*b* and 24*c*) is arranged to feed bills 10 into the receiving mechanism 251, and a sensor S14 (sensors S16 and S18 for the corresponding receiving boxes 24*b* and 24*c*) is arranged in the rear of the feed rollers R34 and R35, that is, in the left portion of FIG. 7.

The delivery mechanism 252 comprises a pick roller R37 for delivering out bills 10, a feed roller R38, and a separate roller R39 for preventing double-feeding of bills 10. The separate roller R39 confronts the feed roller R38 with a certain distance therefrom and is rotated in a direction opposite to the rotation of the feed roller R38. A feed roller R40 is arranged in rolling contact with the feed roller R38 so that bills 10 are delivered out from the delivery mechanism 252. The pick roller R37 is connected to the motor M1 through the clutch C3 (clutches C4 and C5 for the corresponding receiving boxes 24*b* and 24*c*). A sensor S19 (sensors S20 and S21 for the corresponding receiving boxes 24*b* and 24*c*) is arranged in front of the pick roller R37 in the right portion of FIG. 7. An upper plate 241 is arranged above the receiving box 24*a*.

A bill guide 242 is arranged on the inner side of the receiving box 24*a*, and bills 10 are received in the bill guide 242. Bills 10 are held on an accumulating plate 244 urged upward as shown in FIG. 7 by a spring 243 arranged along the outer side of the bill guide 242; thus the bill 10 are pressed upward by a pressing force P. The bill guide 242 is connected to the motor M5 through a transmission mechanism (not shown) and the bill guide 242 is driven by the motor M5 and moved in the vertical direction together with the accumulating plate 244.

When bills 10 are received, the bills 10 guided to the position of the receiving box 24*a* along the route K are deviated from route K by the changeover gate G7, fed by the feed rollers R35 and R36 and introduced into the receiving box 24*a* by the feed roller R34. Since the ring belt 27*c* hung on the pulley P3 is rotated in the direction indicated by the arrow, it exerts a function of pressing down the rear ends of the bills 10 and the bills 10 are stably received.

In accordance with the invention, the bill handling apparatus comprises a bill-disbursing means. As embodied herein the bill-disbursing means includes a bill-disbursing opening and a means for delivering out the bills. When bills 10 are delivered out, the bill guide 242 of the receiving box 24*a* is moved upward together with the accumulating plate 244 so that the bills 10 contact the pick roller R37 with a predetermined pressing force and the pick roller R37 and feed roller R38 rotate intermittently, whereby the bills 10 are delivered out in the direction of the rotation of the feed roller R38. The delivered bills 10 are fed to the route M by the feed rollers R38 and R40, and as described hereinbefore, the bills 10 are fed to a disbursing unit 28 of the bill disbursing opening 3 through the routes Q, K and F.

Figure 8:
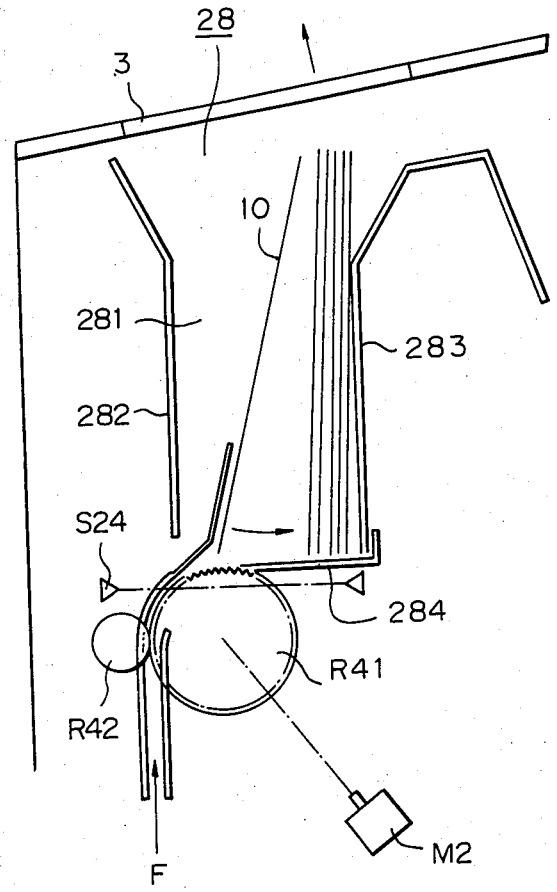
FIG. 8 is a schematic side view of a bill-disbursing unit.

In the disbursing unit 28 for accumulating bills 10 at the bill disbursing opening 3, as shown in FIG. 8, tooth roller R41 and roller R42 are arranged on the rear end of the route F for delivering bills 10, so that they have a rolling contact with each other. The tooth roller R41 is connected to the motor M2. An accumulating zone 281 for arranging bills 10 above the tooth roller R41 is defined by left and right side walls 282 and 283 and a bottom portion 284. The left corner of the bottom portion 284, as shown in FIG. 8 is opened and a sensor S17 is arranged below the bottom portion 284.

Bills 10 fed along the transport passage of the route F are guided to the accumulating zone 281 by the tooth roller R41 and roller R42. Since the lower ends of the bills 10 contact the teeth of the tooth roller R41, they are accumulated in the state aligned along the surface of the side wall 283.

A means for delivering out the bills received in the bill-receiving boxes, via said discriminating means, to said disbursing opening, includes the receiving and delivery mechanisms 25*a* to 25*c*, the disbursing unit 28, the bill disbursing opening 3 and paths M, Q, K and F as shown in FIG. 2.

The receiving and disbursing operations of the apparatus having the above-mentioned structure and functions will now be described with reference to FIGS. 10A through 10D. When a user (customer or teller) depresses a deposit key of the keyboard 4, the shutter in the bill insertion opening 6 is opened. When bills 10 are inserted in the bill insertion opening 6 according to the guide displayed on the display 5, the sensor S1 detects the bills 10 to close the shutter and drive the motor M3. Then, the motor M3 is driven and rotated in the same direction, that is, to the right in FIG. 4, to effect a changeover of the gate G1, whereby the motor M1 is driven to actuate the clutch C1 and the pick roller R1 and feed roller R2 are driven to deliver the bills 10. When the sensor S2 detects the delivered bills 10, the clutch C1 is disconnected. If the sensor S1 does not detect bills 10 any more, delivery is stopped. If bills are still detected by the sensor S1, the clutch C1 is actuated again without detection by the sensor S2 to conduct delivery.

The delivered bills 10 are advanced in the direction of arrow (shown in FIG. 2) along the route B and a discrimination of the genuineness, denomination, and side of the bill is effected in the discriminating unit 8*a*. When a bill 10 is judged as being spurious, the gate G2 is changed over, and the bill 10 is advanced along the routes E and F and detected by the sensors S3 and S23. The passage through the gates G2 and G5 and the introduction into the accumulating zone 281 are confirmed by the sensor S24 and the spurious bill 10 is accumulated in the disbursing unit 28. When no detection is made by the sensor S1, the shutter in the disbursing opening 3 is opened, and the spurious bill 10 is returned and taken out by the user. When a bill 10 is judged as being genuine by the discriminating unit 8*a*, the gate G3 is changed over, and the bill 10 is fed along the route G and detected by the sensor S5. When the front side is out, the bill 10 is advanced in the route H and detected by the sensor S6 and is then accumulated after confirmation of the passage through the gate G4. When the back side is out, the gate G4 is changed over, and the bill 10 is advanced along the route I and detected by the sensor S7. After confirmation of the passage through the gate G4, the bill 10 is turned over and is then accumulated.

After all bills 10 of one transaction are thus accumulated, the transaction amount is shown on the display 5. When the user confirms the amount and depresses the confirmation button, the motor M4 is driven to move the accumulating plate 223 down to the position where the presence of bills 10 is detected by the sensor S8, the motor M2 is driven, and the motor M3 is rotated in the reverse direction, that is, to the left as shown in the drawings. Then, the motor M1 is rotated and the pick roller R26 and feed roller R27 are rotated by the clutch C2 to deliver out the bills 10. When the delivery of the bills 10 is detected by the sensor S9, the clutch C2 is disconnected. If no bills are detected by the sensor S8 the delivery is completed. If bills 10 are detected by the sensor S8, the clutch C2 is actuated again without detection by the sensor S9, to conduct the delivery. The delivered bills 10 are advanced along the route J and then along the route K and then advanced through the discriminating unit 8*a* in the direction of arrow D. The denomination and condition are then discriminated. The gate G5 is changed over, the bills 10 are advanced along the route L, and the passage is confirmed by the sensor S11. If a damaged condition is detected or if the discrimination cannot be effected due to double-feeding or the like, the gate 6 is changed over, the bill is advanced along the route N, the passage is confirmed by the sensor S12, and the bill is recovered in the reject box 23. Faultless bills 10 whose denomination have been discriminated are advanced along the route M. The gates G7 through G9 are changed over according to the discriminated denomination, the passage through the gates G7 through G9 and the receipt of the bills 10 are confirmed and detected by the sensors S13 through S18, and the bills 10 are received in the receiving boxes 24*a* through 24*c*.

On the other hand, after the transaction amount is displayed, and when the user depresses the stop deposit or cancel key, the gate G5 is changed over. The bills 10 are transported along the route F, accumulated in the disbursing unit 28, and returned to the user.

Figure 10A:
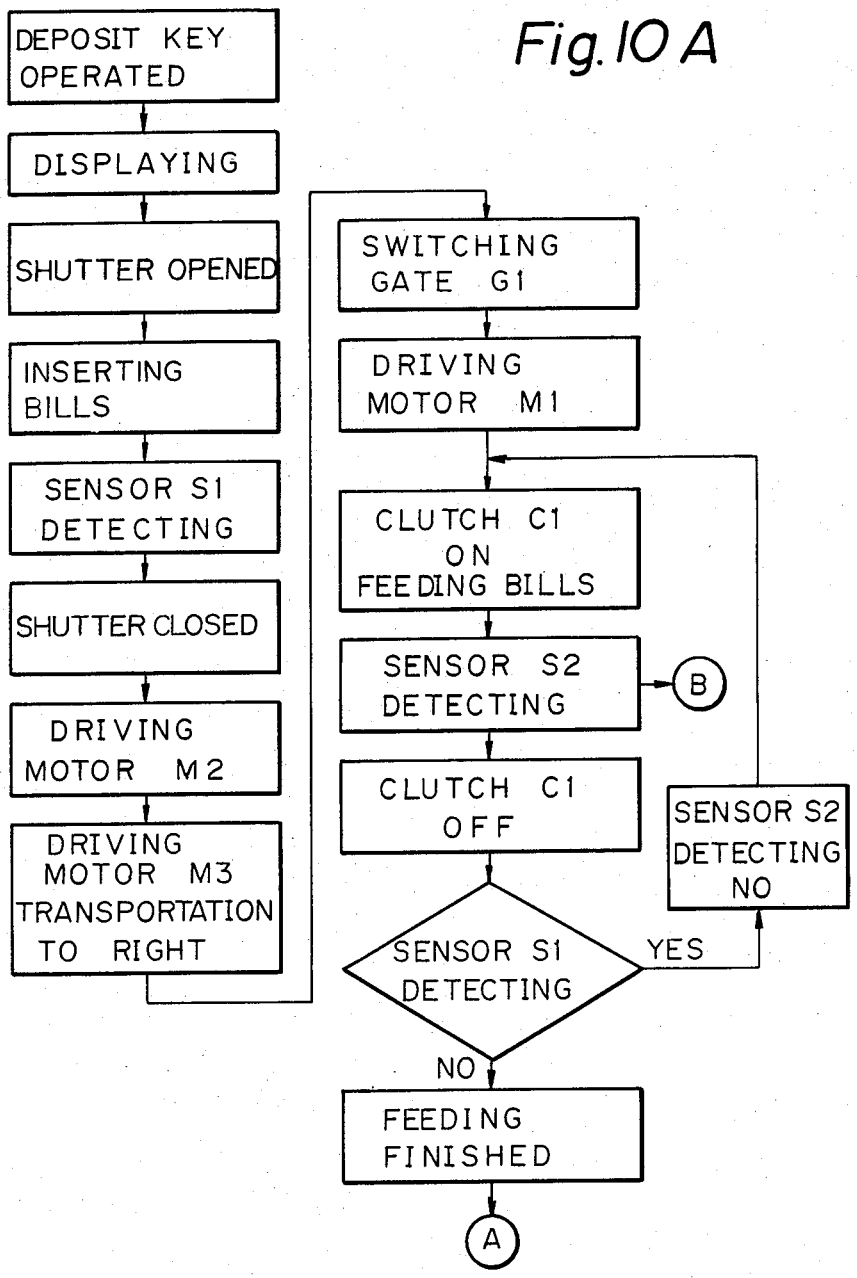
FIGS. 10A, 10B, 10C, and 10D are flow charts of the depositing process.
Figure 10B:
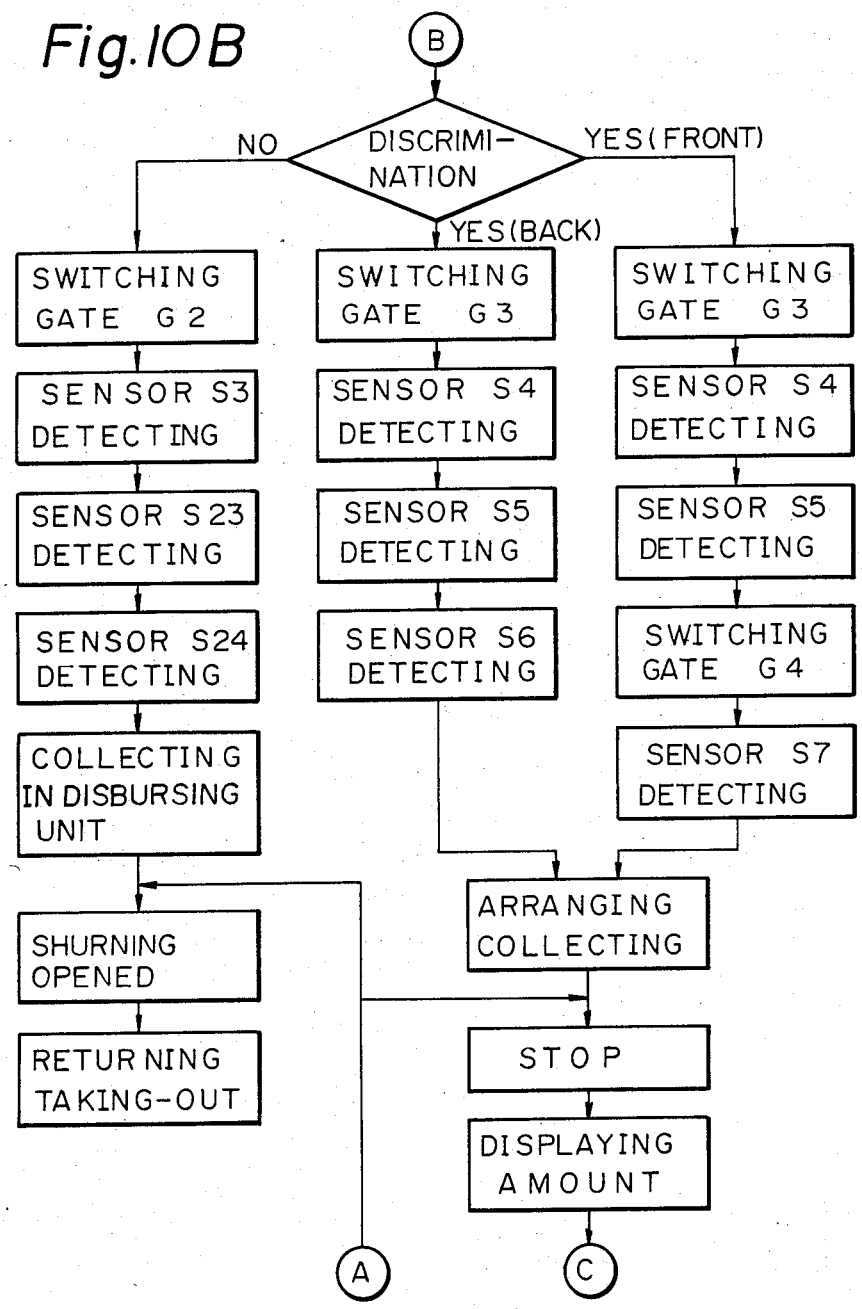
Figure 10C:
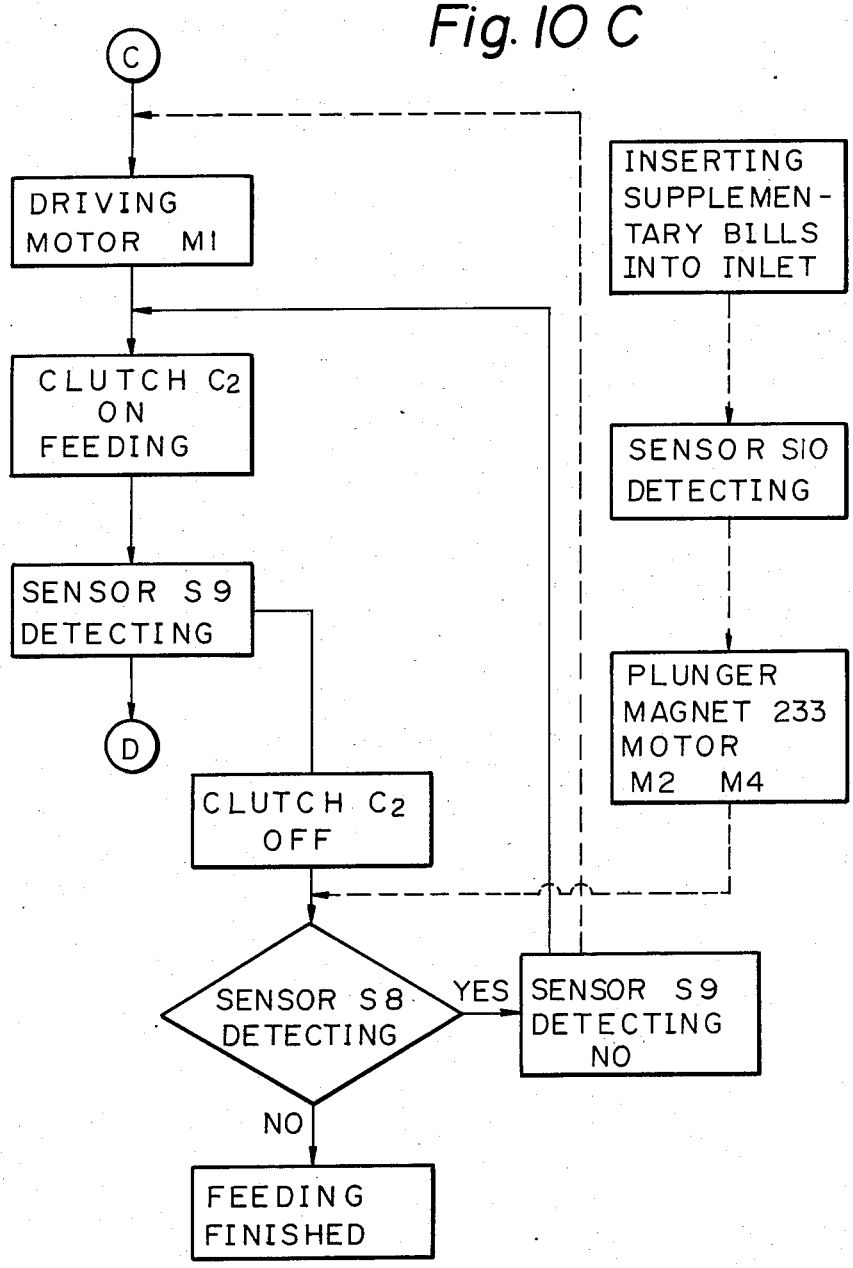
Figure 10D:
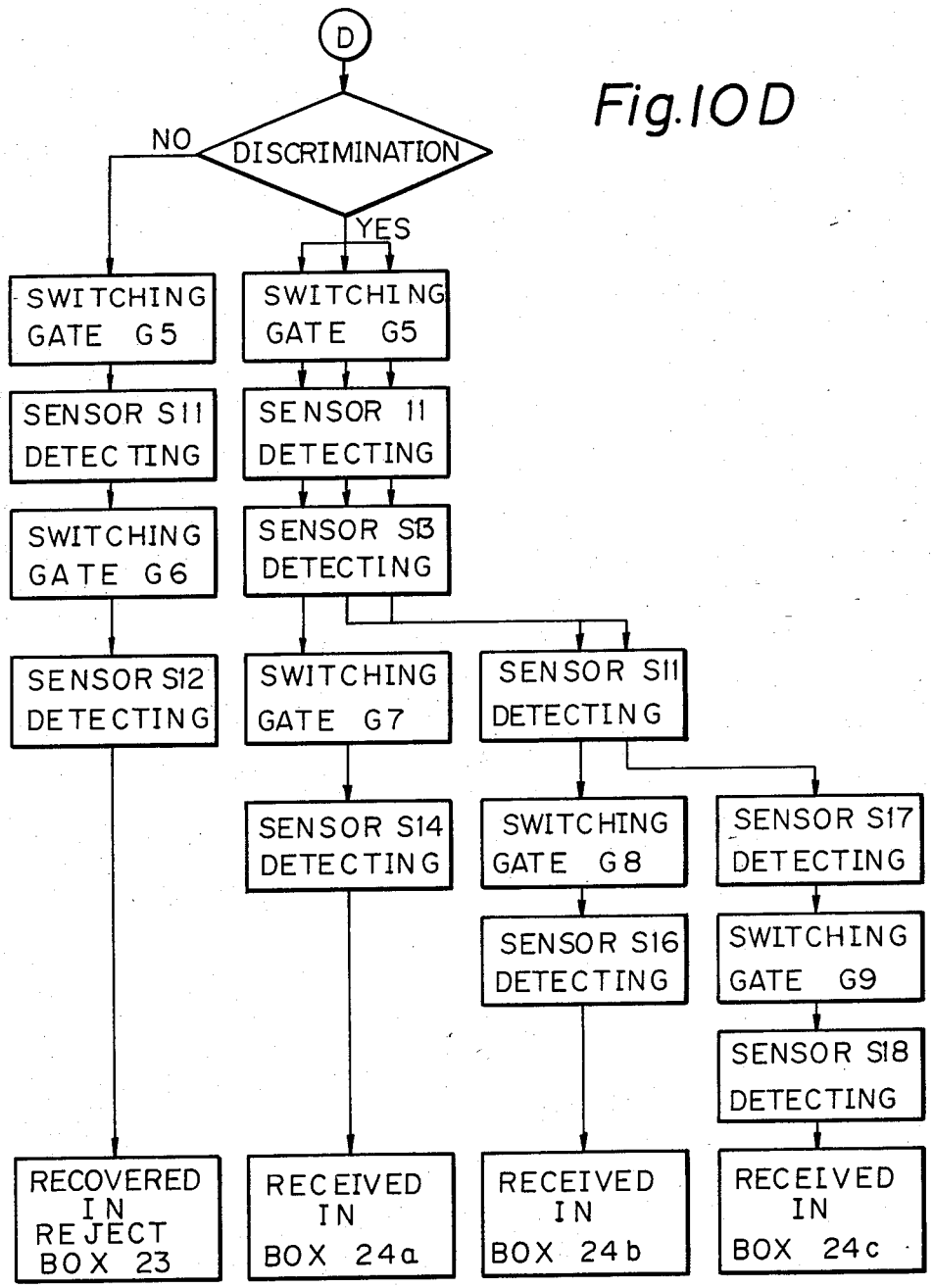

In the case of supplying supplementary bills into the receiving boxes 24*a* through 24*c*, a predetermined number of bills are inserted through the inlet opening 19*a* as indicated by a dashed arrow in FIG. 10C. The insertion is detected by the sensor S10 to actuate the plunger magnet 223 to grip the bills 10 between the upper and lower rollers R31 and R32. The motor M4 is driven to bring down the accumulating plate 223. The motor M2 is driven to feed the bills 10 into the delivery unit 22*a*. The bills 10 are detected by the sensor S8, delivered in the same manner as described above with reference to the receiving operation, and received in any of the receiving boxes 24*a* through 24*c* according to denomination.

Figure 11A:
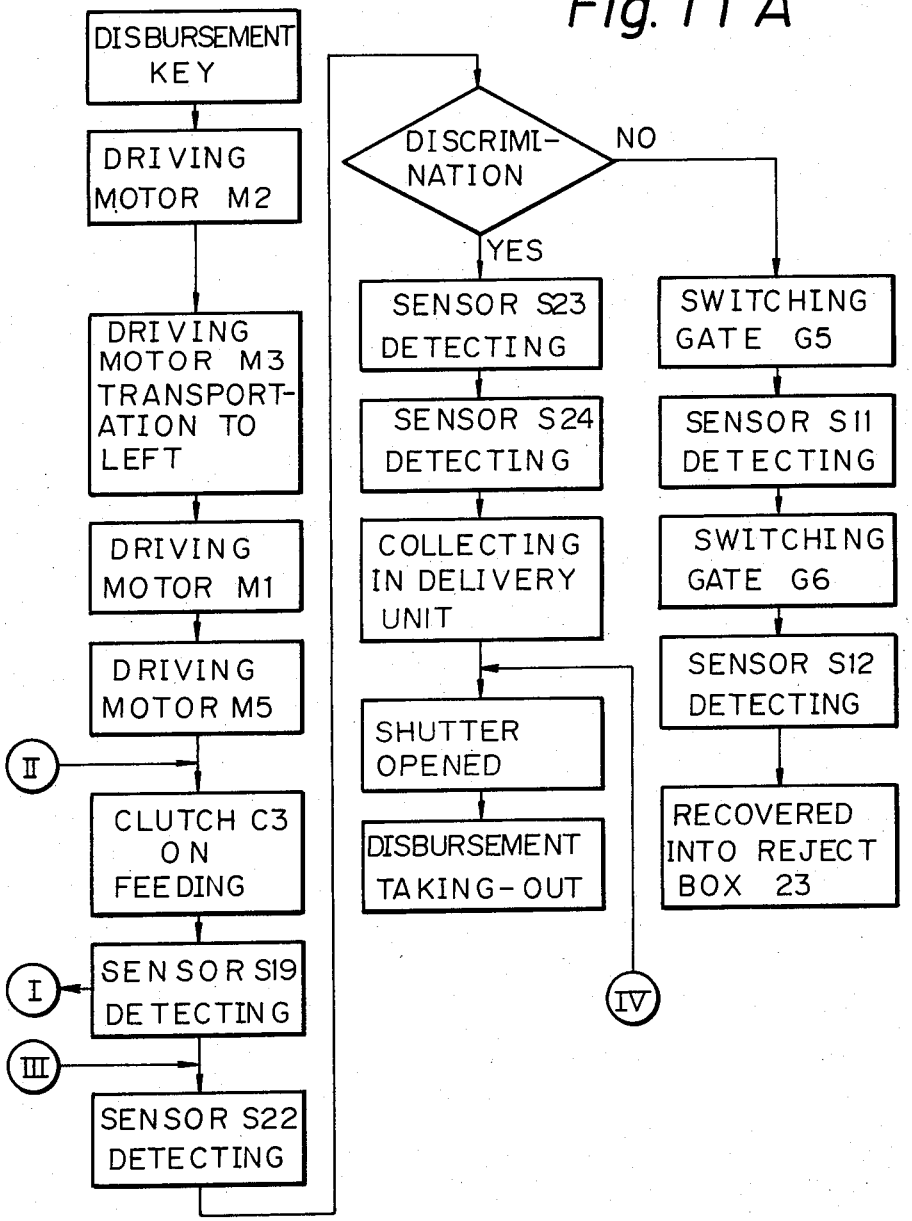
FIGS. 11A and 11B are flow charts of the disbursing process.
Figure 11B:
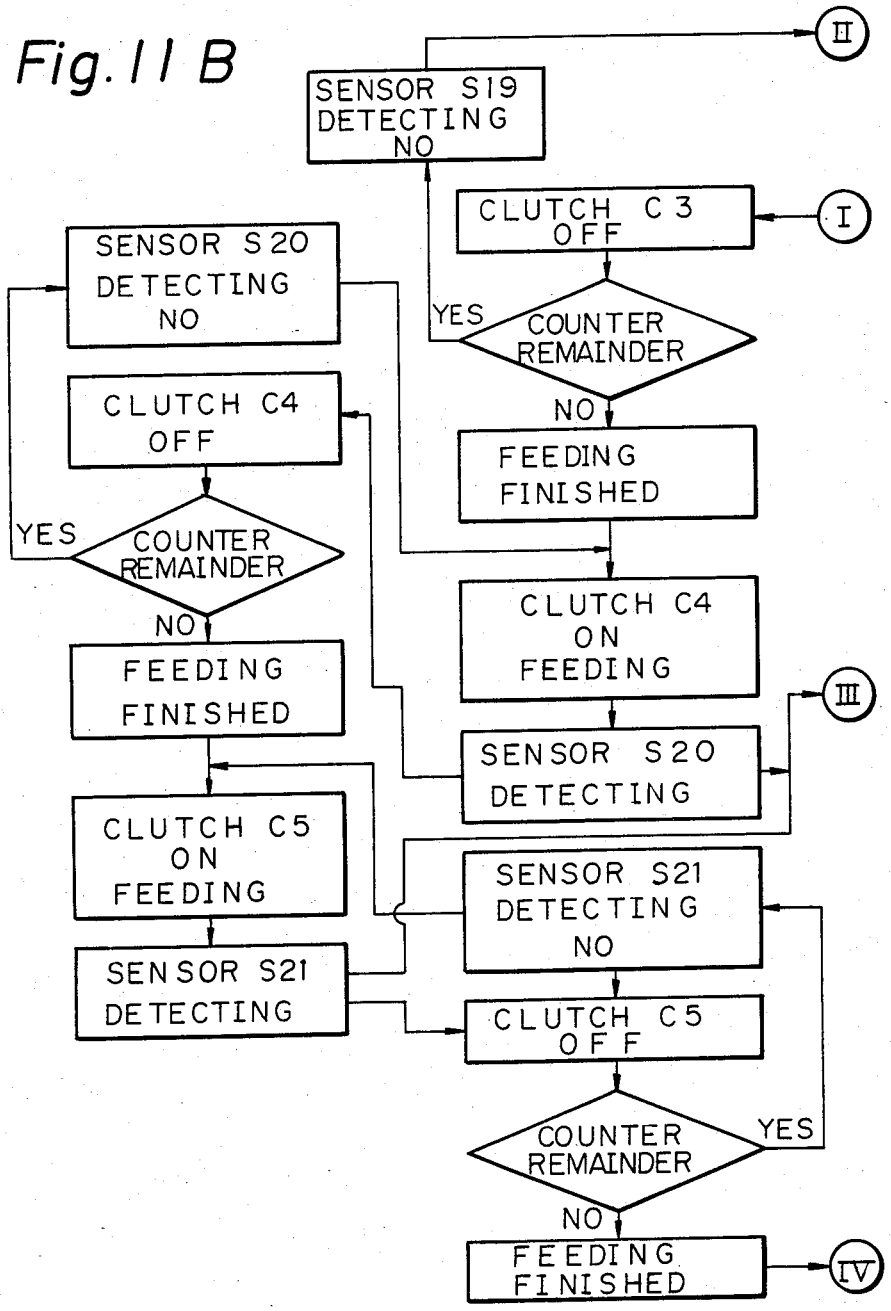

At the time of disbursement, as shown in FIGS. 11A and 11B, when the user keys an amount of money and depresses the confirmation button, the numbers of bills 10 of the respective denominations are set and are indicated on a counter (not shown) in the control unit 18.

The motors M2 and M3 are rotated. The motor M1 is then rotated to actuate the clutch C3 to rotate the pick roller R37 and feed roller R38. At this point, the motor M5 is driven to raise the bill guide 242 of the receiving box 24*a*, and the bills 10 are pressed by the pick roller R37 and feed roller R38 and are delivered out.

When the denomination of delivered bills 10 from the receiving box 24*a* is correct, the delivery of the bills 10 is confirmed by the sensor S19, and the clutch C3 is disconnected. If no number is left on the counter, the delivery is completed. If any number is left on the counter, the clutch C3 is actuated again without detection by the sensor S19 to continue the delivery. On termination of the delivery, bills 10 of the denomination corresponding to the receiving boxes 24*b* and 24*c* are delivered out in succession in the same manner as described above.

The delivered bills 10 are fed to the discriminating unit 8*a* through the routes M, Q and K. The discrimination of the denomination and the condition is effected in the discriminating unit 8*a*. In case of damaged condition, double-feeding, or excessive delivery, the gates G5 and G6 are changed over, bills are advanced through the routes L and N, the passage is confirmed by the sensors S11 and S12, and the bills are recovered in the reject box 23.

The reject box 23 has two compartments 23*a* and 23*b*, one of which, for example 23*a*, is used for recovering damaged bills, and the other of which, 23*b*, is used for the bills which are not discriminated in the discriminating unit and the excessively delivered bills. The changeover of the paths for access of bill to the compartments 23*a* and 23*b* is performed by changeover gate GR, which is controlled by the control unit 18.

When bills are judged as being faultless and of the intended denominations in the discriminating unit 8*a*, the passage through the gate G5 is detected and confirmed by the sensor S23, the bills are advanced along the route F, the passage is detected by the sensor S24, and the bills are accumulated in the disbursing unit 28. When disbursement is completed, the shutter in the disbursing opening 3 is opened and the bills 10 are taken out by the user. If bills are left behind by mistake, these bills are rejected and placed in the compartment 23*b* of the reject box 23.

As is apparent from the foregoing description, the apparatus of the present invention is provided with a mechanism for making the front and back sides of the deposited bills face the same direction. Therefore, the deposited bills are received in the state where the front and back sides face the same direction. As these arranged bills are used for the disbursement, customer service is improved. Moreover, even if the depositing transaction is stopped, bills can be returned in the state where the front and back sides of the bills 10 face the same direction.

Furthermore, a single discriminating unit is used for both the acceptance of deposit and the disbursement. Accordingly, the discriminating unit and transport passages can be simplified and the number of parts and members can be reduced, and therefore, another effect of reducing the manufacturing cost can be attained.

We claim:

1. A bill handling apparatus, comprising:

(a) a bill-receiving means including:

(i) a bill insertion opening in which bills are inserted by users, (ii) discriminating means for discriminating bills, (iii) arranging and accumulating means, operatively connected to said discriminating means, having a bill arranging mechanism for arranging bills so that the front and back sides thereof face the same direction, according to a determination of the orientation of the bills made by said discriminating means, and having a bill accumulating mechanism for accumulating the arranged bills, said arranging and accumulating means comprising:

a pair of feed rollers in rolling contact, arranged on opposite sides of the path of the bills, a tiltable gate element, operatively connected to said discriminating means, and disposed below said feed rollers, a top plate arranged below said gate element, and having an upper and a lower position, a supporting member, an accumulating plate, arranged below said top plate, rotatably supported on said supporting member and having an upper and a lower position, drive means for moving said top plate and said accumulating plate independently, in the vertical direction, from said upper position to said lower position, a first pair of feed rollers in rolling contact, arranged on one side of said top plate and said accumulating plate, and a second pair of feed rollers in rolling contact, arranged on the other side of said top plate and said accumulating plate and, wherein said tiltable gate element directs a bill to be selectively fed to one of said first and said second pairs of feed rollers according to the result of the determination of the orientation of the bill in said discriminating means, such that the bills are arranged on said accumulating plate with the front and back sides of successive bills facing the same direction, (iv) a plurality of bill-receiving boxes for receiving bills according to denomination, (v) first feeding means for feeding the bills inserted in said insertion opening to said bill arranging and accumulating means, (vi) second feeding means, operatively connected to said discriminating means, for feeding genuine bills to said arranging and accumulating means and for returning non-genuine bills to the user, according to a determination of the authenticity of the bills made by said discriminating means, and (vii) third feeding means for feeding the bills accumulated in said bill arranging and accumulating means, via said discriminating means, to said bill-receiving boxes;

(b) a bill-disbursing means including:

(i) a bill-disbursing opening from which bills are disbursed to users, and (ii) a means for delivering out the bills received in said bill-receiving boxes, via said discriminating means, to said disbursing opening; and (c) a reject box for recovering genuine bills for which no determination is made in said discriminating means, and other bills which are unsuited for disbursement.

2. An apparatus according to claim 1, wherein said bill-arranging and accumulating means further comprises a delivery unit for delivering the bills accumulated on said accumulating plate, and wherein said delivery unit is located in the lower position of said top plate and said accumulating plate.

3. An apparatus according to claim 2, further comprising an inlet, operatively connected to said delivery unit, for supplying supplementary bills to said bill-receiving boxes.

4. A bill handling apparatus, comprising:

(a) a bill insertion opening into which bills are inserted by users;

(b) discriminating means for discriminating the genuineness and orientation of the bills inserted in said insertion opening;

(c) arranging and accumulating means, operatively connected to said discriminating means, comprising:

a bill arranging mechanism for arranging bills determined to be genuine by said discriminating means, so that the front and back sides of successive bills face in the same direction according to the orientation of the bills determined by said discriminating means, and a bill accumulating mechanism for temporarily accumulating the arranged bills;

(d) means, operatively connected to said discriminating means, for returning bills determined to be non-genuine by said discriminating means to the user;

(e) input means for obtaining the user's confirmation of a deposit and the user's refusal of a deposit;

(f) a plurality of bill-receiving boxes, each bill-receiving box including receiving rollers for feeding the bills into the box and delivering rollers for delivering out the bills from the box, and each bill-receiving box receiving bills of a single denomination with the front and back sides of successive bills facing in the same direction;

(g) a receiving mechanism, operatively connected to said input means and said arranging and accumulating means, for feeding bills accumulated in said bill arranging and accumulating means into said plurality of bill-receiving boxes according to the denomination of the bills, in response to an input of the user's confirmation of the deposit, and for feeding the bills accumulated in the arranging and accumulating means, via the discriminating means, to a bill-disbursing opening upon receipt of the user's refusal of the deposit;

(h) a delivering mechanism for delivering out bills in the bill-receiving boxes; and (i) a disbursing mechanism, including said bill-disbursing opening, for disbursing the bills delivered out by said delivering mechanism to a user.

5. A bill handling apparatus, comprising:

(a) a bill insertion opening into which bills are inserted by users;

(b) delivering means for delivering one-by-one the bills inserted into the bill insertion opening;

(c) discriminating means for discriminating the genuineness and the orientation of the delivered bills;

(d) returning means for returning the bills discriminated as being non-genuine to the user;

(e) bill arranging means for arranging the bills judged as being genuine so that the front and back sides of the bills face in the same direction, the bill arranging means having two feed routes, gate means for selectively distributing the bills to one of the two feed routes, and control means for controlling the gate means according to the orientation of the front and back sides of the bills;

(f) accumulating means including upper and lower guide members for receiving bills from each of the two feed routes from respective, opposite ends of the upper and lower guide members, and temporarily accumulating the bills judged as being genuine and arranged by the bill arranging means between the upper and lower guide members;

(g) display means for displaying the total value of the bills accumulated in the accumulating means;

(h) input means for obtaining a user's confirmation of the displayed value of the bills, and (i) receiving box means, comprising:

a plurality of receiving boxes for receiving the bills of different denominations, respectively, accumulated in the accumulating means in accordance with the user's confirmation of the displayed value of the bills, and a plurality of bill-disbursing mechanisms for delivering out the bills from the respective bill-receiving boxes.

6. A bill handling apparatus according to claim 5, wherein each of the two feed routes for feeding the bills to the accumulating means begin at the gate means and end at the accumulating means and wherein the two feed routes have equal lengths.

7. A bill handling apparatus according to claim 5, wherein the accumulating means includes upper and lower guide plates, drive means for moving the guide plates between an upper position and a lower position, and delivering rollers disposed in a position corresponding to the lower position of the guide plates, and wherein the bills are accumulated between the upper and lower guide plates and the delivering rollers deliver the bills accumulated between the guide plates.

8. A bill handling apparatus, comprising:

(a) a bill insertion opening into which bills are inserted by users;

(b) a first delivering mechanism for delivering one-by-one the bills inserted into the insertion opening;

(c) discriminating means for discriminating the genuineness and the orientation of the delivered bills;

(d) arranging and accumulating means for arranging the bills so that the delivered bills have the same orientation and temporarily accumulating the bills judged as being genuine by the discriminating means and arranged to have the same orientation;

(e) display means for displaying the total value of the bills accumulated in the arranging and accumulating means;

(f) input means for receiving the user's input of acceptance and refusal of the deposit;

(g) a second delivering mechanism responsive to the input of acceptance and refusal of the deposit by the input means to deliver one-by-one the bills accumulated in the arranging and accumulating means;

(h) receiving means for receiving the bills delivered by the second delivering mechanism from the arranging and accumulating means;

(i) returning means for returning the bills in the arranging and accumulating means to the users; and (j) bill distributing means responsive to the input by said input means for feeding one by one the bills delivered by the second delivering mechanism into said receiving means, in accordance with an input of the acceptance of the deposit, and feeding one-by-one the bills delivered by the second delivering mechanism into the returning means, in accordance with an input of the refusal of the deposit.

9. An apparatus according to claim 8, wherein each of the first and second delivering mechanisms include feed rollers for separating and delivering the bills and wherein the bills delivered from each of the first and second delivering mechanisms are fed into the discriminating means.

10. An apparatus according to claim 8, wherein the bills delivered from the first and second delivering mechanisms are fed into the discriminating means from opposite sides of the discriminating means.

11. An apparatus according to claim 8, further comprising an auxiliary inlet for inserting supplementary bills to the accumulating and arranging means.

12. An apparatus according to claim 8, wherein the accumulating means includes upper and lower guide plates defining a space for accumulating the bills.

13. An apparatus according to claim 12, wherein the upper and lower guide plates are movable between an upper postion for accumulating bills between the guide plates, and a lower position for delivering the bills accumulated between the guide plates.

14. An apparatus according to claim 8, wherein the returning means includes a second accumulating means for temporarily accumulating the bills one-by-one, ejecting means for ejecting the bills accumulated in the second accumulating means, and an outlet opening from which bills are ejected.

15. An apparatus according to claim 8, wherein the receiving means includes a plurality of bill-receiving boxes, each bill-receiving box corresponding to and receiving a single denomination of bills.

* * * * *

UNITED STATES PATENT AND TRADEMARK OFFICE

CERTIFICATE OF CORRECTION

PATENT NO. : 4,625,870

DATED : December 2, 1986

INVENTOR(S) : Nao et al.

It is certified that error appears in the above-identified patent and that said Letters Patent is hereby corrected as shown below:

Col. 1, line 29, "storage" should be --stoppage--.

Col. 2, line 18, after "a" insert --third--.

Col. 3, line 10, "F" should be --I--;

line 10, after "2" insert --Bills determined to be non-genuine are returned to the user by a second feeding means including paths E and F and disbursing unit 28, shown in Fig. 2. In addition, bills pooled in the arranging and accumulating unit 22 can be returned to the user via paths J and K, the discriminating unit 8a, path F and the disbursing unit 28, as shown in Fig. 2.--.

UNITED STATES PATENT AND TRADEMARK OFFICE

CERTIFICATE OF CORRECTION

PATENT NO. : 4,625,870

DATED : December 2, 1986

INVENTOR(S) : Nao et al.

It is certified that error appears in the above-identified patent and that said Letters Patent is hereby corrected as shown below:

Col. 4, line 3, "comprised" should be --comprises--.

Col. 6, line 17, delete "or sending"; after "delivering" insert --or sending--;

line 34, "55" should be --S5--;

line 49, "position" should be --portion--.

Col. 8, line 34, "bill" should be --bills--;

line 50, after "apparatus" insert --further--.

Signed and Sealed this

Twenty-first Day of April, 1987

*Attest:*

DONALD J. QUIGG

*Attesting Officer*

*Commissioner of Patents and Trademarks*